United States Patent [19]

Umbenhauer

[11] Patent Number: 4,471,542

[45] Date of Patent: Sep. 18, 1984

[54] EASY-CLAMP SCROLL FRAME

[76] Inventor: Donald J. Umbenhauer, 3000 Linda La., Wilsh Hills, Sinking Spring, Pa. 19608

[21] Appl. No.: 400,057

[22] Filed: Aug. 30, 1982

[51] Int. Cl.[3] ..... D05C 1/02

[52] U.S. Cl. ..... 38/102.7; 160/395; 211/45; 211/180

[58] Field of Search ..... 38/102.7, 102.4, 102.1; 160/395; 211/45, 180

[56] References Cited

U.S. PATENT DOCUMENTS

| | | | |
|---|---|---|---|
| 323,898 | 8/1885 | Anderson | 160/395 |
| 800,591 | 9/1905 | Payen | 38/102.4 |
| 1,298,323 | 3/1919 | Freiwald | 38/102.4 |
| 1,739,552 | 12/1929 | Kidder | 160/395 X |
| 1,987,860 | 1/1935 | Milone | 160/395 |
| 2,288,492 | 6/1942 | Silvernail | 38/102.4 |
| 2,381,029 | 8/1975 | Beil | 160/395 |
| 2,709,489 | 5/1955 | Keebler | 160/395 X |
| 3,098,280 | 7/1963 | Harris et al. | 38/102.4 |
| 4,189,856 | 2/1980 | Cookson | 38/102.4 |

FOREIGN PATENT DOCUMENTS

| | | | |
|---|---|---|---|
| 6814631 | 4/1970 | Netherlands | 38/102.7 |

*Primary Examiner*—Werner H. Schroeder
*Assistant Examiner*—Andrew M. Falik
*Attorney, Agent, or Firm*—Leonard Michael Quittner

[57] ABSTRACT

An art needlework scroll frame is disclosed in which the free edges of the base fabric are held in step clamps which provided uniform transverse tension to the fabric without damage thereto and which maintains perpendicularity in the warp and weft of the fabric.

4 Claims, 4 Drawing Figures

FIG. 1
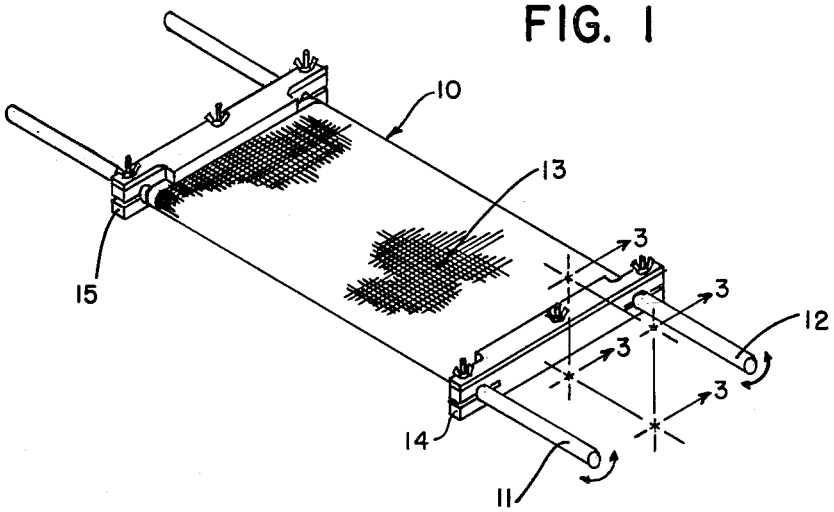
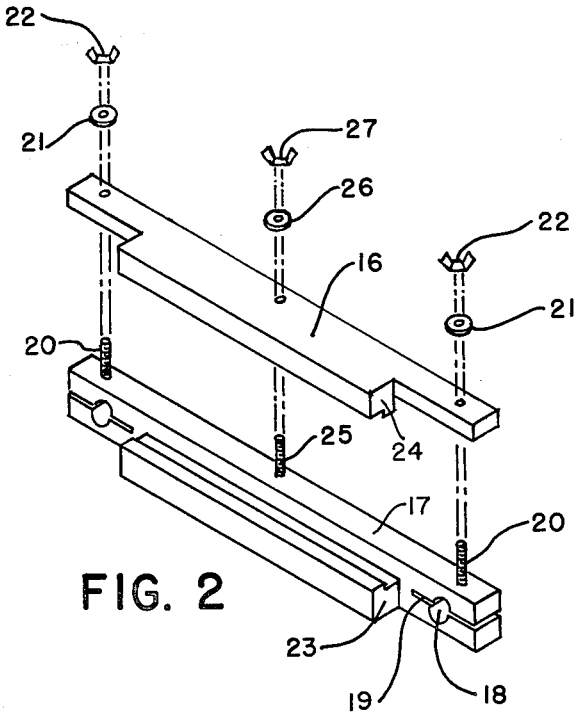
FIG. 2
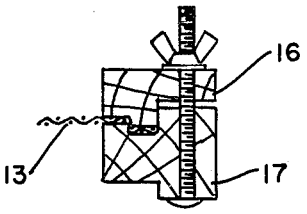
FIG. 3a
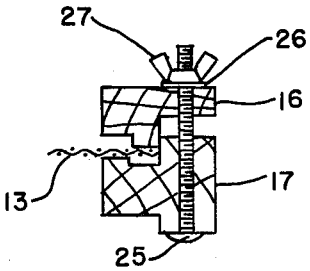
FIG. 3b

EASY-CLAMP SCROLL FRAME

BACKGROUND OF THE INVENTION

1. The Field of the Invention

The field of the invention pertains to rectangular wooden needlework frame apparatus of the scroll-end type, in which the scrolls are of circular cross-section, are freely rotable of which are held apart by slidably adjustable transverse arms and in which the scrim or other base fabric material upon which art needlework, such as petit point, needlepoint, crewel, embroidery, longstitch, quilting and the like to be performed, are held. The fabric, of necessity, is substantially longer in its length than in its width and the excess, non-working portion of length is wound upon the scrolls. Other types of frame such as hoops which define a circular work area, or fixed frames, in the manner of picture frames, are also known in the art but present different problems than are addressed by the present invention.

2. Description of the Pior Art

Scroll frames have been found useful in the needlework art to mount the fabric which is usually, but not always, a coarsely woven fabric in which the strands of warp and weft are woven perpendicularly to each other and a design or key to be rendered by the worker is lightly imprinted thereover as a guide. It has proved essential that the work area defined between the scrolls and transverse arms must be stretched taut or under substantial tension to facilitate the stitchery and such that the perpendicular orientation of the strands, and the over printed key thereon, be maintained without distortion.

This has been attempted in various ways as, for example, tensioning the free edges of the work area by means of tacks receiving hooks, spikes or staples mounted on or driven into the transverse arms which hold the scrolls apart. U.S. Pat. No. 3,098,280 to Harris et al is a good example of the state of the art, as are the Creative Circle, 1982, catalogue page 34, item #NPFR; Mary Maxim, Inc., 1983, catalogue page 37, Item No. 051631; Cirriculum Resources, 1981/82, catalogue page 12, Item No. 56026; J. C. Penney, 1983 catalogue page 899; Item Nos. SWU 705-1965A, WU 705-0065A; Artcraft Concepts, Rev. 7/82, Flyer, Item No. 8101; copies of which are provided. The worker, in most of the instances cited, when wanting to change the work area must detach the tacks and re-install them after the work area is redefined by scrolling. This can cause damage to the fabric, a loss of perpendicularity and the creation of irregular tension in addition to the tedious problem of relocating the tacks with attendant damage to the transverse arm each time a change is made. Harris shows a small, book hinge-like device installed on the transverse arm which when closed will merely hold a central portion of the free edge by means of spikes located on the inner face of the hinge. The problems of perpendicularity and tension are, however, left to chance or are inadequately disposed of without substantial, slidable resetting of the space between the free edges held by transverse arms. The smaller central holding area taught by Harris et al, furthermore, leaves substantial portions of the free edge under less tension than that positioned under the hinge device. Therefore, substantial portions of the work area are not provided with transverse tension. Harris also teaches the use of spikes which can be damaging to the fabric and ignores the problem maintaining perpendicularity.

Known to the applicant, but without the specific reference available or even knowlege that it is, in fact, prior art, is the invention of another which in combination with the scrolls is a simple clamping device in the manner of a lady's skirt press in which two (2) essentially flat members attached to a transverse arm are pressed together by compression locking means, thereby holding the fabric in place. While no spikes or tacks are used in this method, the two essential desiderata of perpendicularity and uniform tension are attempted but achieved only partially.

The present invention eliminates all of the foregoing problems, provides a simple, quick means to shift work area and assures maintenance of the proper tension with no loss of perpendicularity or damage to the fabric.

SUMMARY OF THE INVENTION

The present invention provides the art needle worker with a scroll frame consisting of circular cross-section scrolls conventionally disposed on slidably adjustable transverse arms, essentially the whole of which are step clamps. The unique design of these clamps ensures when locked, as will be shown, full, uniform tension across the whole work area including the free edges, perfect maintenance of perpendicularity and no damage to the fabric. Additionally, the clamps are easily loosened so that the work area maybe readily shifted by the scrolls and easily tightened so that the scrolls may not rotate as tension is reapplied across the scrolls and to the free edges. The length and width of the work area are easily defined without distortion as could otherwise occur with the use of tacks, spikes or the like and uniform tension is re-established.

The transverse arms of the present invention are made of essentially bar-shaped pairs of upper, movable members and lower fixed, scroll holding members. Each pair of upper and lower member then can be brought together compressibly to hold the free edge of the fabric by tightening means such as a thumb nut on carriage bolt passing through both the lower and the upper member. The bolt is centrally located on the arm outward of the free edge so as not to interfere therewith. Additional, similar bolt and thumb nut scroll tightening means are fitted near the ends of the upper and lower member, each lower member containing near its end and inclusive of the end bolt a slotted circular passage which is designed to receive an end portion of a circular cross-section scroll arm, thereby enabling the scroll to be locked when the end nut is tightened or rotated when the end nut is loosened.

The upper member has formed along the length of the inner edge of its longitudinal lower surface a downward step portion which mates with an upward step portion formed along the length of the elevated longitudinal surface of the lower member and between the scroll passages such that when the two members are compressed together with fabric aligned between the two stepped surfaces, the fabric, starting with the free edge is folded into a "zee" when viewed from the scroll end. In so doing, uniform tension is applied to the fabric starting at the free edge, along the rise of the step and inward to the work area along substantially the entire length of the arm. This also ensures uniform tension along substantially the entire free edge of the work area. The fabric is locked firmly between the upper and lower members with perpendicularity assured if the free edge or any adjacent weft strand is first lined up parallel to the step, a matter easily done by eye. The apparatus described is conducive to all manner of art needle work since the compression can be regulated to accommondate any thickness of fabric or any type of weave, a feature not available in other types of scroll frame apparatus.

The fabric is fitted along an edge of its width to the scroll arms which are rotated to locate the work area of interest to the artesan. The free, lengthwise edges are passed through the gap created by the loosened upper member of the transverse arm and over the lower member of the transverse arm. When the desired work area is located and proper tension is created in the longitudinal direction between the scrolls, these are first moderately and later tightly locked. The artesan then aligns the wefts of the fabric with the inward longitudinal edge of the upper and lower members of a transverse arm, the members of which are then compressed and locked by the thumb nut thereby ensuring perpendicularity. After locking, these actions are repeated on the other loosened transverse arm which may be further slidably adjusted outwardly, thereby creating appropriate tension without distortion in the transverse direction and preserving perpendicularity. Accurate art needlework is then carried out in the work area which is now under sufficient tension in all directions. Perpendicularity is maintained and no damage to the fabric takes place.

Shifting the work area is easily accomplished by loosening the thumb nuts which control the locking of the scrolls appropriately and repeating the setting, aligning and locking process.

No tools, tacks, spikes or hooks are involved and the art needleworker is substantially convenienced. Also to be noted is the fact that the central holding bolt assembly may be eliminated in versions of the present invention in which the width between scrolls is substantially reduced, the end tightening means serving to provide adequate transverse tension in smaller work areas.

Other procedures, modifications and simplifications will occur to one skilled in the art without changing the spirit of the invention as he reads the specification herein.

DESCRIPTION OF DRAWINGS

4 FIGS. on one (1) sheet are provided.

FIG. 1 is a perspective view of the scroll frame fully assembled with fabric installed on the scrolls and under tension created by the transverse clamps.

FIG. 2 is an exploded perspective view of the transverse arm clamp.

FIG. 3*a* is a cross sectional view through "3—3" of the transverse arm clamp in the locked position holding the free-edge of the fabric in place under tension FIG. 3*b* is the same view but with the transverse arm clamp loosened and the free edge of the fabric floating under no tension.

DESCRIPTION OF THE PREFEREED EMBODIMENT

An art needle work scroll frame (10) made of wood comprising a circular cross-section front scroll (11) and a circular cross-section rear scroll (12) both of which are rotable clockwise or counter-clockwise for the purpose of receiving and winding thereon a scrim, or base facric (13), which is substantially longer in its length than its width. The scrolls are held apart and in parallel orientation by a slidably adjustable right hand transverse arm (14) and a slidably adjustable left-hand transverse arm (15). The distance between the transverse arms may be varied by sliding either or both arms toward or away from each other over the scrolls. Each transverse arm consists of an upper, or clamping member (16) and a lower, or holding, member (17). The lower member has located near each end a circular, through-passage (18) disposed perpendicularly to the longitudinal axis of the lower member for the purpose of receiving a scroll. A through slot (19) is disposed centrally to the elevation of each end of the lower member and in a plane perpendicular to the elevation, which slot continues into the circular through-passage and beyond along the longitudal axis of the lower member a sufficient distance such that when an end portion of a scroll is inserted in the passage and compression is applied above and below the slot, by tightening means such as for example, a carriage bolt (20), washer (21) thumb nut (22) the slot will be compressed, the scroll's rotation will be impeded and the scroll will become locked.

The lower member has integrally formed inward of the bolts and along the length of its inner elevated surface between the slots, milled in its upper surface inward toward the body of the member an upward step portion (23) in the form of a rectlineal channel, which mates compressibly with a downward step portion (24) which is integrally formed therewith inward of the bolts and along the length of the lower longitudinal surface of the upper member in the form of a reticlineary ridge.

The lower member may have fitted through it additionally (and optionally with that version of the present invention which is designed to accept a larger work area), an additional compression means such as a carriage bolt (25), washer (26) and thumb nut (27) outward of the upward step portion and located centrally to the longitudinal axis of the lower member, the bolt of which extends upward and centrally through the upper member and outward of the downward step portion such that when the thumb nut is tightened the upward step portion of the holding member and the downward step portion of the clamping member are placed compressibly in contact with each other as shown in FIG. 3*a*.

To operate the appartus, an edge of the width of the fabric is attached to the front scroll, as for example, with masking tape, all the thumb nuts are loosened and the fabric is wound on the front scroll a few turns. The opposing edge of the fabric width is similarity mounted on the rear scroll which is wound sufficiently to take up the balance of the length. A transverse arm is slid toward a free edge of the fabric (13) such that the fabric fits into the gap created between the loosened upper and lower members of the transvere arm as shown in FIG. 3*b*. The scroll thumb nuts (22) are moderately tightened. The other transverse arm is similarly slid into position with the other free edge fitted into the gap as before. The scrolls (11) are then wound in opposition stretching the fabric in the longitudinal direction and the scroll thumb nut tightened, locking the rolls. The clamping thumb nut (27) is then tightened, assuring that each free edge of the fabric is folded into a "zee" as shown in FIG. 3*a*. This applies uniform transverse tension to the fabric and assures perpendicularity between warp and weft in the fabric.

What is claimed is:

1. A wooden art needle work frame apparatus of the scroll type, in combination, comprising:

(a) a pair of circular cross-section scrolls of which one is a front scroll and another is a rear scroll on which are wound a length of art needlework fabric substantially longer in its length than in its width such that a length is defined between the scrolls;

(b) a pair of transverse arms, of which one is a right-hand arm and another is a left-hand arm, which arms are slidably mounted on the scrolls such that the arms will define a width of the fabric;

(c) each transverse arm further comprising:

(1) a lower, bar-shaped holding member to hold the scrolls apart by a defined width between them and having situated along a lower portion of an inward elevated surface and integrally formed along the length of said surface, an upward step such that the step forms a channel of rectilinear cross-section along said surface and (2) an upper, bar-shaped, or clamping member of a length equal to that of the lower member and having an inner elevated longitudinal surface on which intergrally formed along the length of said surface a downward step such that the steps forms a ridge of rectilinear cross-section with the upper member and which mates compressably with the channel of the lower member;

(d) compressing and locking means located outward of the scrolls and through the arms such that the scrolls may be locked such that longitudinal tension is applied to the defined length of the fabric longitudinally and the upper and lower members maybe compressed together to hold the defined length of the fabric compressibly along a free edge of the fabric such that the free edge is led inwardly and longitudinally and is folded and held between said member in a "zee" shape in the channel and below the ridge, the arms being held and compressed a distance apart such that tension is applied transversely to the defined width of the fabric.

2. As in claim 1, wherein the compressing and locking means are carriage bolts, washers and thumbnuts.

3. A wooden art needle work scroll frame apparatus clamp mounted on a transverse arm thereof comprising:

(a) a lower bar-shaped holding member having a front end and a rear end through which ends in a plane perpendicular to the longitudinal axis of the member and near its ends are located slotted circular passages which hold rotable front and rear circular cross-section scrolls which slidably define a distance apart between them and have locking and compressing means located on the end side of the passage such that the scrolls maybe locked and having integrally formed on and along an inner elevated, longitudinal surface of said lower member inward of the passages, (1) an upward step which integrally forms a channel of rectilinear cross-section along the inner elevated longitudinal surface and (b) an upper, bar-shaped, clamping member having a front end and a rear end defining a length equal to the lower member having integrally formed along an inner elevated, longitudinal surface of said upper member, (1) a downward step such that the step forms along said inner surface a ridge of rectilinear cross-section with the upper member and mates compressibly with the lower member channel and having (2) compressing and locking means in line with, through and above the upper member such that the clamping member and the holding member may be compressed together and such that when a free edge of a length of art needle work fabric is inserted and compressed between the upper and lower member the fabric leading from the free edge inward longitudinally is folded and held between said members into a "zee" shape.

4. As in claim 3, where the compressing and locking means are carriage bolts, washers and thumb nuts.

* * * * *